US005302443A

United States Patent [19]

Manning et al.

[11] Patent Number: 5,302,443

[45] Date of Patent: Apr. 12, 1994

[54] CRIMPED FABRIC AND PROCESS FOR PREPARING THE SAME

[75] Inventors: James H. Manning, Appleton; Joseph H. Miller, Menasha; Robert J. Marinack, Oshkosh; Mary J. Filen, Appleton, all of Wis.

[73] Assignee: James River Corporation of Virginia, Richmond, Va.

[21] Appl. No.: 751,121

[22] Filed: Aug. 28, 1991

[51] Int. Cl.[5] ..... D02G 3/00; D03D 25/00; D04B 1/00; D04H 13/00

[52] U.S. Cl. ..... 428/224; 428/362; 428/369; 428/370; 428/373; 428/296

[58] Field of Search ..... 428/362, 369, 370, 373

[56] References Cited

U.S. PATENT DOCUMENTS

| | | | |
|---|---|---|---|
| 4,049,491 | 9/1977 | Brandon et al. | 162/157 |
| 4,158,594 | 6/1979 | Becker et al. | 428/195 |
| 4,551,378 | 11/1985 | Carey, Jr. | 428/288 |
| 4,692,368 | 9/1987 | Taylor et al. | 428/137 |
| 4,692,371 | 9/1987 | Morman et al. | 428/224 |
| 4,781,966 | 11/1988 | Taylor | 428/152 |
| 4,783,231 | 11/1988 | Raley | 264/518 |
| 4,787,947 | 11/1988 | Mays | 156/160 |
| 4,789,699 | 12/1988 | Kieffer et al. | 428/286 |
| 4,883,707 | 11/1989 | Newkirk | 428/370 |
| 4,939,016 | 7/1990 | Radwanski et al. | 428/152 |
| 5,019,211 | 5/1991 | Sauer | 162/146 |
| 5,082,720 | 1/1992 | Hayes | 428/370 |

FOREIGN PATENT DOCUMENTS 2160473 12/1985 United Kingdom .

OTHER PUBLICATIONS

Product Brochure, "Chisso ES FIBER—Thermo-bonding Bicomponent Polyolefin Fiber", pp. 1-7; approximate publication date Sep. 1984 or earlier.

*Primary Examiner*—George F. Lesmes
*Assistant Examiner*—Kathryne Elaine Shelborne
*Attorney, Agent, or Firm*—Birch, Stewart, Kolasch & Birch

[57] ABSTRACT

A fabric which can be made by a wet-laid process using crimpable bicomponent fibers is disclosed which may have a high bulk and/or elasticity. The fabric can be made by a high speed continuous process wherein the fabric is pulled from a Yankee dryer by a take off roll which rotates faster than the Yankee dryer.

26 Claims, 5 Drawing Sheets

CRIMPED FABRIC AND PROCESS FOR PREPARING THE SAME

BACKGROUND OF THE INVENTION

1. Field of the Invention

The present invention relates to a thermally crimped fabric and a process for the preparation thereof.

2. Description of Background Art

Thermal crimping of fabrics is known in the art as disclosed, for example, in U.S. Pat. Nos. 3,947,315, 4,551,378 and 4,732,809. However, the properties of these fabrics render them unsuitable for certain uses.

SUMMARY OF THE INVENTION

The present invention is directed to thermally crimped fabrics having desirable properties such as elasticity and/or high bulk. The present invention is also directed to an improved process for preparing elastic and/or high bulk fabrics.

The present invention is particularly useful in the preparation of wet-laid fabrics having characteristics heretofore not obtainable by wet-laid processes. In particular, by following the teachings of the present invention, a wet-laid fabric having a bulk of at least 7 $cm^3/g$, preferably at least 9 $cm^3/g$, more preferably at least 12 $cm^3/g$ or a degree of elasticity of at least 5% can be prepared. The crimping of the fibers forms a product having a high degree of bulk and also elasticity. In one embodiment of the present invention, a crimped fabric having thermally bonded fibers which are crimped in a first direction to a degree which is substantially greater than the degree of crimp in a second direction, which is perpendicular to the first direction, is produced. Because of these unique crimping properties, the fabric has a degree of elasticity in the first direction which is greater than the degree of elasticity in the second direction.

The present invention is also directed to a process for preparing a crimped fabric which comprises the steps of crimping a fabric comprising thermally bondable fibers while restraining said fibers in a first direction to an extent less than the degree of restrain in a second direction which is perpendicular to said first direction at a temperature and other conditions which cause said fibers to bend or crimp in said second direction to an extent which is higher than the extent said fibers bend or crimp in said first direction.

The present invention is also directed to a wet-laid process for preparing wet-laid fabrics having unique properties which comprises the steps of forming a non-woven fabric of crimpable fibers by a wet-laid process and heating the non-woven fabric under conditions which allow the fibers to crimp to form a crimped fabric having a bulk of at least 7 $cm^3/g$ or a degree of elasticity in at least one direction of at least 5%.

DETAILED DESCRIPTION OF THE PREFERRED EMBODIMENTS

Definitions

Figure 1:
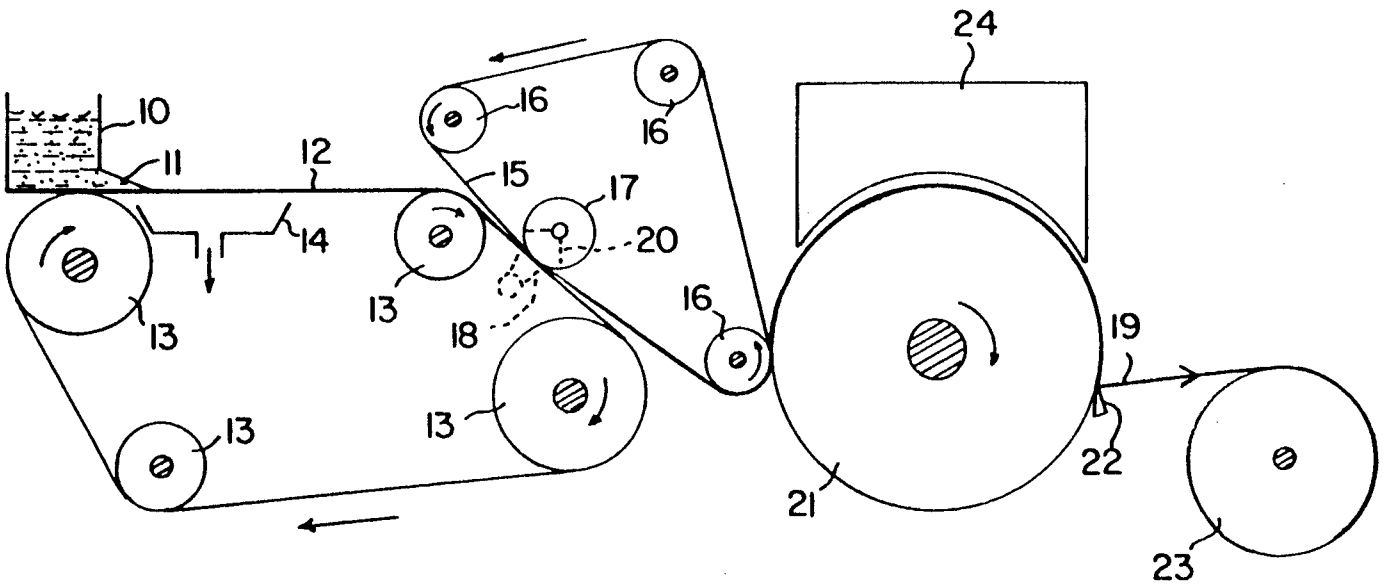
FIG. 1 is a schematic representation of a Fourdrinier tissue machine useful in the present invention wherein a wet-laid fabric is presented to a Yankee dryer and is thereafter crimped.

As used herein, a "wet-laid" process is a process wherein a liquid slurry of fibers (i.e., a mixture of fibers, a liquid such as water or another suitable liquid and other conventional additives such as disclosed in U.S. Pat. Nos. 4,822,452 and 4,498,956) is applied to a foraminous support such as a woven wire web to form a non-woven fabric. Wet laid processes include traditional wet laid processes as well as foam forming processes wherein a fiber-containing foam is applied to the support. The fibers are preferably laid down in a substantially random orientation.

"Necked material" is a material which has been constricted in at least one dimension by processes such as drawing or gathering.

"Basis weight" refers to mass per unit area of a material.

Sample thickness was determined using a standard procedure for tissue samples. In this method eight sheets are measured together using a two-inch anvil at a pressure of 0.38 psi. The apparatus used was a TMI Special Model 551-M motorized micrometer with 50.8 mm (2 inch) diameter anvils and 539±30 grams dead weight load, available from Testing Machines, Inc., 400 Bayview Avenue, Amityville, N.Y. 11701. The thickness of the sheets is measured after conditioning the sheets at least 24 hours at 23° C. (73° F.) at 50% relative humidity (RH).

"Bulk" means volume of a material per unit of mass; bulk is the reciprocal of density. Bulk is measured by dividing the sample thickness, i.e., caliper (cm) by basis weight ($g/cm^2$).

"Peak load" means maximum value of load or force obtained in elongating a sample to break.

"Elongation" refers to an increase in length of a material before rupture relative to its original length; expressed as a percentage, elongation is [(final length−initial length)/(initial length)] X 100.

"Tensile energy absorption" (TEA) is work done when a material is stressed to rupture in tension; it is the total energy absorbed by the material divided by the area over which the force acts. Tensile energy absorption may be calculated by dividing the area under a graph of load vs. elongation, up to the point of rupture, by the area of the sample (test length X width).

Tensile testing was carried out on a Model 4502 Instron which is a constant rate of extension instrument. Testing was done in both MD and CD using 1-inch by 5-inch samples, a gauge length of 4 inches, a crosshead speed of 10 inches/minute, and line contact grips. Samples were conditioned at least 24 hours at 23° C. and 50% RH.

"Length recovery" is the degree to which the extension of a stretched material is diminished after the biasing force is removed; it is expressed as a percentage as

[(maximum stretched length−final sample length)/(maximum stretched length−initial sample length)] X 100.

"Holding power" is load maintained after a specified length of time when a material is stretched; it is generally measured following a series of load - unload cycles in which the load is maintained in the last cycle.

"Stress decay" is the percentage of loss in load after a specified length of time when a material is stretched; stress decay is [(final load−initial load)/(initial load)] X 100.

"Degree of Elasticity" as used herein means the amount that the fabric can be stretched without breaking and wherein at least 95% of the linear deformation is recovered when the tension is released from the fabric.

MATERIALS AND PROCESS CONDITIONS

Various different types of fibers can be used to prepare the fabric of the present invention. In order for crimping to take place, some of the fibers must crimp or shrink when subjected to the processing conditions employed in preparation of the fabric and some of the fibers must be capable of thermally bonding to other fibers. Thus, the fabric can be formed from a mixture of thermally bondable fibers and fibers which crimp. The fabric may contain fibers which possess both of these properties, i.e., fibers which are thermally bondable and which also crimp.

Particularly preferred fibers are bicomponent fibers which have a first component, e.g., a first polymer, having a first melting point (m.p.) and a second component, e.g., a second polymer, having a second melting point which is lower than the first melting point. The bicomponent fibers can be sheath/core type fibers wherein the core is composed of a first polymer having a first melting point and the sheath is composed of a second polymer having a second melting point which is lower than the first melting point. The sheath and core can be arranged concentrically or in a slightly or highly eccentric relationship. Alternatively, the bicomponent fibers can be arranged in a side-by-side, i.e., co-linear, relationship.

The melting point of the low melting component is lower than the temperature at which crimping will take place and usually at least 30° C. lower than, preferably at least 40° C. lower than the melting point of the higher melting point component. The lower melting component of the bicomponent fiber can be any thermal plastic bondable polymer which is capable of bonding to other materials when heated to at least the melting point of the polymer and thereafter cooled. Thermal plastic bondable polymers which may be useful as the second polymer include polyolefins, polyamides, copolyamides, copolyesters, polyesters, acrylics, etc.

The melting point of the second polymer is normally 110° to 200° C., preferably 115° to 130° C. The high melting component of the bicomponent fiber may be any polymer which is capable of being formed into a fiber. The high melting component is usually formed from a polymer which has a higher strength than the low melting component. Suitable high melting components of the bicomponent fiber are polyolefins, polyamides, polyesters, acrylics, etc. The m.p. of the high melting component is preferably higher than the temperature of the fabric during crimping so that the fibers maintain a certain degree of structural integrity during crimping.

The uncrimped fabric is preferably formed by a wet-laid process. Suitable wet-laid processes include a foam forming process of the type described in U.S. Pat. No. 4,498,956, an associative thickener process of the type disclosed in U.S. Pat. No. 4,925,528 and an air emulsion technique of the type described in U.S. Pat. No. 4,049,491. The processing conditions employed in U.S. Pat. No. 4,822,452 may be employed. The fibers can be formed into a non-woven fabric by a crescent former of the type described in U.S. Pat. No. 3,326,475, which is hereby incorporated by reference or by a Fourdrinier machine.

Fibers of various different sizes and physical configurations can be used. The fibers are preferably linear or substantially linear prior to crimping. Fibers which should be particularly useful have an average denier (d) of 0.5 to 15 denier, preferably 1 to 4 d and an average length of 5 to 40 mm, preferably 8 to 20 mm.

Bicomponent fibers may also be blended with other fibers which are not thermally bondable bicomponent fibers. Such additional fibers may include conventional staple fibers, microfibers and even other bicomponent fibers. However, the thermally-bondable bicomponent fibers must be present in sufficient amount to achieve the necessary thermal-bonding and desired stretch characteristics. Generally, thermally-bondable, bicomponent fibers should comprise at least 50% by weight, preferably at least 75% by weight of the fibers of the fabric to obtain the desired bonding and stretch. The fabric may contain 100% bicomponent fibers.

The fabric, prior to thermal crimping, usually has a bulk of 2 to 6, preferably 3 to 5 $cm^3/g$.

The unique stretch characteristics of the fabric of the present invention are preferably achieved by crimping a fabric under conditions wherein the fabric is restrained in a first direction to an extent different from the degree of restraint in a second direction which is perpendicular to the first direction. For example, the fabric can be restrained or stretched in one direction to a certain degree and can be completely unrestrained in a second direction which is perpendicular to the first direction.

When the fabric is prepared by a wet-laid process, the fabric is initially formed and then presented to a Yankee dryer. While the fabric is on the surface of the Yankee dryer, the fabric is heated to a temperature which is (1) at least equal to and preferably higher than the melting point of the lower melting component of the bicomponent fibers, (2) above the Tg of the higher melting component of the bicomponent fibers and (3) below the m.p. of the higher melting component of the bicomponent fibers. The temperature of the fabric when it leaves the Yankee dryer, and thus during thermal crimping, is usually between about 250° to 300° F. (121° to 149° C.), preferably 260° to 290° F. (127° to 143° C.). It is preferable not to employ physical crimping such as stuffer box crimping.

When the fabric is pulled from the Yankee dryer, the fibers are essentially free of restrain in the cross-machine direction (CD) and are subjected to restrain in the machine direction (MD) to cause the fibers of the fabric to buckle in the cross direction when pulled off the heated Yankee drum while the sheet of the polymer is at its melting point. The strain on the fabric is preferably created by rotating the take off reel at a peripheral speed which is greater than the peripheral speed of the Yankee dryer. The speed of the take off reel is preferably at least 5% and more preferably at least 10% greater than the speed of the Yankee dryer.

The process appears to work best at very high speeds such as at least 1000 fpm (305 mpm), preferably at least 2000 fpm (610 mpm), more preferably 2500 to 5000 fpm (762 to 1524 mpm). The speed referred to in this paragraph is the speed of the fabric as it leaves the Yankee dryer. If the process is conducted at low speeds, it may be necessary to provide additional heat to the fabric during stretching, i.e., after it leaves the Yankee dryer, so that the fiber sheath does not solidify or lose its tackiness prematurely.

The web can then be allowed to cool at ambient temperature and can be rolled into a roll. The resulting fabric will have a high degree of cross-directional elasticity stretch as compared with the degree of elasticity in the machine direction.

After the uncrimped fabric is formed, the fabric is thermally crimped to produce a product which has a degree of elasticity in one direction which is at least 5%, preferably 10 to 75%, more preferably 50 to 70%, a bulk of 7 to 20, preferably 9 to 18, more preferably 10 to 16 $cm^3/g$. The crimped fabric will usually have a thickness of 0.005 to 0.2 mm, preferably 0.01 to 0.1 mm.

The degree of elasticity in the first direction is usually at least 5%, preferably 10 to 75% and more preferably 50 to 65% greater than the degree of elasticity in the second direction (perpendicular to the first direction) which will usually be approximately zero % when the fabric is restrained in the second direction during crimping.

The present invention provides a substantially uniform cross-directional stretch fabric. The fabric has excellent formation, low density and low power comfort stretch with uniform thickness, weight and density.

The fabric of the present invention has potential use wherever high bulk and/or elasticity are desired. For example, the fabric would be particularly useful in the diaper cover area. The product is higher in loft than products produced by certain conventional techniques and has an elastic component in the cross-direction which would be desirable in disposable diapers (baby diapers, toddler training pants or adult diapers). The fabric may also be useful in making special wall coverings.

FIG. 1 schematically illustrates a Fourdrinier papermaking machine which is capable of forming a web to which the method of the present invention is applied. This general type of machine is described in U.S. Pat. No. 4,158,594, the entire contents of which are hereby incorporated by reference. A headbox 10 is provided to hold a supply of fiber furnish, which generally comprises a dilute slurry of fibers and water. The headbox 10 has a slice 11 disposed over the moving surface of a condenser 12, which in this embodiment comprises a foraminous woven wire such as a Fourdrinier wire. The fiber furnish in headbox 10 issues from the slice 11 onto the surface of the wire 12. The wire 12 is carried through a continuous path by a plurality of guide rolls 13, at least one of which is driven by a drive means (not shown). A vacuum box 14 is disposed beneath the wire 12 and is adapted to assist in removing water from the fiber furnish in order to form a web from the fibers. In addition, other water removal means, such as hydrofoils, table rolls, and the like (not shown), may be employed beneath the upper flight of the wire 12 to assist in draining water from the fiber furnish. Upon nearing the end of the upper flight of the Fourdrinier wire 12, the web is transferred to a second carrying member 15, which may be either a wire or a felt. This second carrying member 15 is similarly supported for movement through a continuous path by a plurality of guide rolls 16.

The transfer of the web from wire 12 to member 15 is accomplished by lightly pressing the carrying member 15 into engagement with the web on the wire 12 by a pickup roll 17. Actual web transfer from wire 12 to member 15 may be accomplished or assisted by other means such as an air knife 18 directed against the surface of wire 12 opposite the web, or a vacuum box 20 within the pickup roll 17, or both, such means being well-known to those skilled in papermaking techniques. At least one of the rolls 16 or 17 supporting the second carrying member 15 is driven by means (not shown) so that member 15 has a speed preferably equal to the speed of the wire 12 so as to continue the movement of the web. The web is transferred from member 15 to the surface of a rotatable heated dryer drum 21 such as a Yankee dryer. The carrying member 15 is lightly pressed into engagement with the surface of the drying drum 21 to which it adheres, due to its moisture content and its preference for the smoother of two surfaces. As the web is carried through a portion of the rotational path of the dryer surface, heat is imparted to it. Typically, heat will come not only from the Yankee but from auxiliary heating unit 24 which could be hot air or infrared heaters. Generally, most of the moisture therein is removed by evaporation. The web 19 is removed from the dryer surface in FIG. 1 by a creping blade 22, although it could be removed therefrom by peeling it off without creping if this were desired.

The hot web is pulled off the Yankee dryer 21 by a driven reel 23. To make the product have CD stretch, the reel must have surface speed higher than the Yankee dryer.

EXAMPLE 1—High CD Stretch Web

A web consisting of 100% Hoechst Celanese Celbond K56, 2d×10 mm fiber was produced on a pilot scale paper machine. Celbond K56 fibers are 2d×10 mm proprietary bicomponent fibers having a polyolefin sheath and a concentric polyester (polyethylene terephthalate) core. The fibers were prepared in a batch process in a pulper containing 2000 gallons (7570 liters) 100° F. (37.8° C.) water, 2.9 pounds (1.32 kg) Rohm and Haas QR-708, 60 gallons (227 liters) of a 0.6% solution of Calgon Hydraid 7300C, and 300 pounds (136 kg) of fiber. A second pulper was prepared in the same manner and the contents of both pulpers were combined in the machine chest with a final volume of 7000 gallons (26,495 liters).

Figure 2:
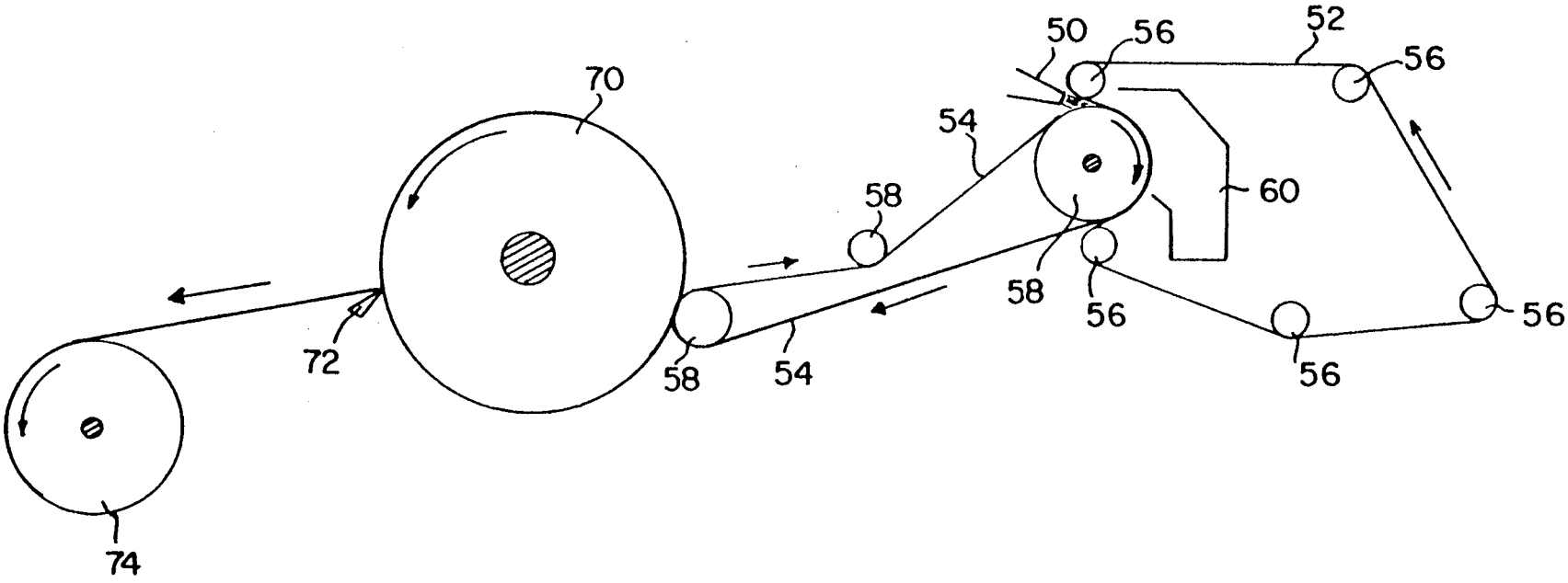
FIG. 2 is a schematic representation of a machine useful in the present invention wherein a web is formed in a Cresent Former, presented to a Yankee dryer and thereafter crimped.

The fiber slurry was formed into a web by use of a Beloit Crescent Former which is schematically shown in FIG. 2. This crescent former is not a twin wire gap former because a felt and wire are used. The fiber slurry is distributed (squirted) by a nozzle 50 of a pressurized headbox between a forming wire 52 and a felt 54 which are traveling at 3000 fpm (914 mpm). The wire 52 is supported by a plurality of guide rolls 56 and the felt 54 is supported by guide rolls 58. Most of the water is removed through the wire and is collected in a saveall 60. The consolidated fibrous web is retained on the felt which carries the fibrous web to a Yankee dryer. As the web passed over a 12 foot diameter Yankee dryer 70 heated to 265° F. (129° C.), the fiber sheath softened, flowed, and bonded the fibers to one another. As the web touched a creping blade 72 with a 45° bevel, it was pulled by the reel 74 which was running at 3450 fpm (1052 mpm), 15% faster than the wire. This pulling action caused the web to neck down producing a high cross directional buckling of the CD fibers which thereby results in fabrics having CD elasticity. The physical properties of the substrate produced (100% Celbond K-56 Bicomponent Fiber Web having CD Elastic Stretch) are listed in Table 1 under Sample No. 2639-6.

TABLE 1

| Sample No. | 2639-6 | 3302-1 |
|---|---|---|
| % draw | 15% | 0% |
| Yankee temp (°F.) | 265 | 257 |
| BW (lb/3000) | 7.2 | 12.2 |
| Caliper (mils) | 7.3 | 6.9 |
| Bulk ($cm^3/g$) | 15.82 | 8.79 |
| Tensile (g/in) (Dry) MD | 576 | 1623 |
| Tensile (g/in) (Dry) CD | 241.6 | 1518.3 |
| Elongation before breaking (%) MD | 15 | 15.3 |
| Elongation before breaking (%) CD | 60 | 16.8 |
| Geo. Mean Dry Tensile Strength (g/in) | 373 | 1569.6 |
| Dry Breaking Length (m) | 1253 | 3123 |
| Tear (g) MD | 46 | 127 |
| Tear (g) CD | 101 | 114 |
| Tear Factor ($g/m^2/g$) | 582 | 608 |
| Mullen (Dry) (pts) | 4.7 | 18.2 |
| Burst Factor | 28 | 65 |
| Frazier Air Perm. (CFM) | N/A | 898 |

Figure 4:
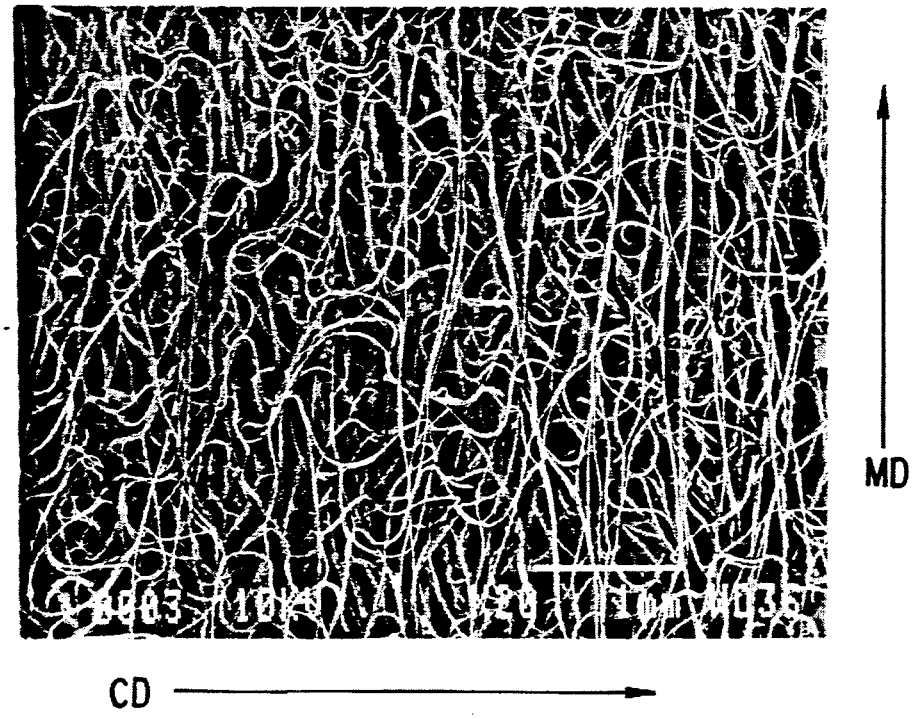
FIG. 4 is a SEM (20 X magnification) of a fabric of 100% sheath/core bicomponent fiber wherein the fibers are buckled in the cross machine direction.
Figure 5B:
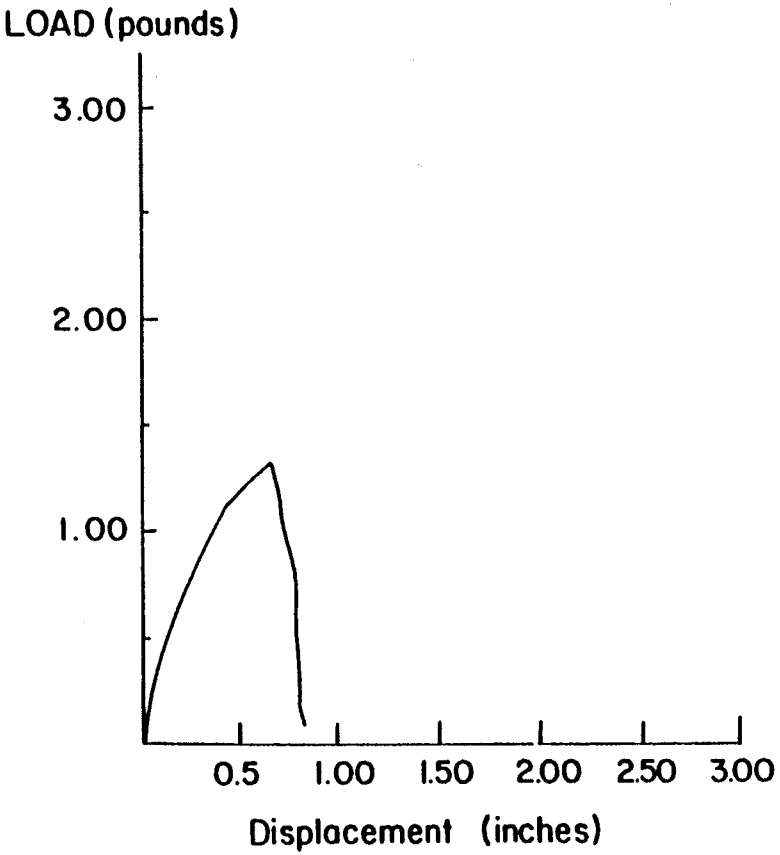
FIGS. 5A–5D are graphs of load versus elongation for samples 2639-6 CD, 2639-6 MD, 3437-6 CD and 3437-6 MD, respectively.
Figure 5A:
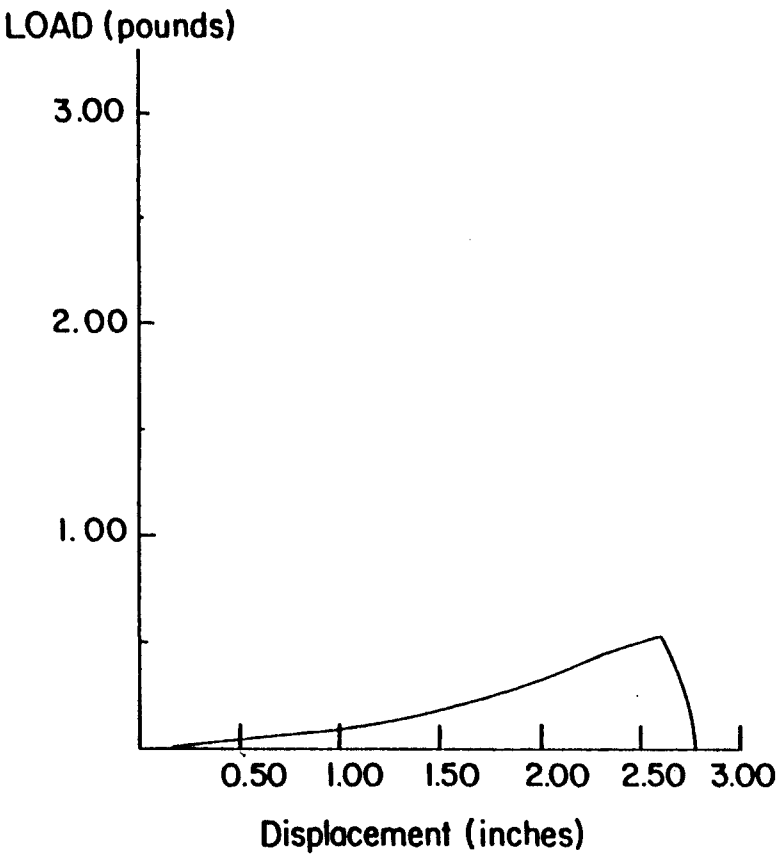
Figure 5D:
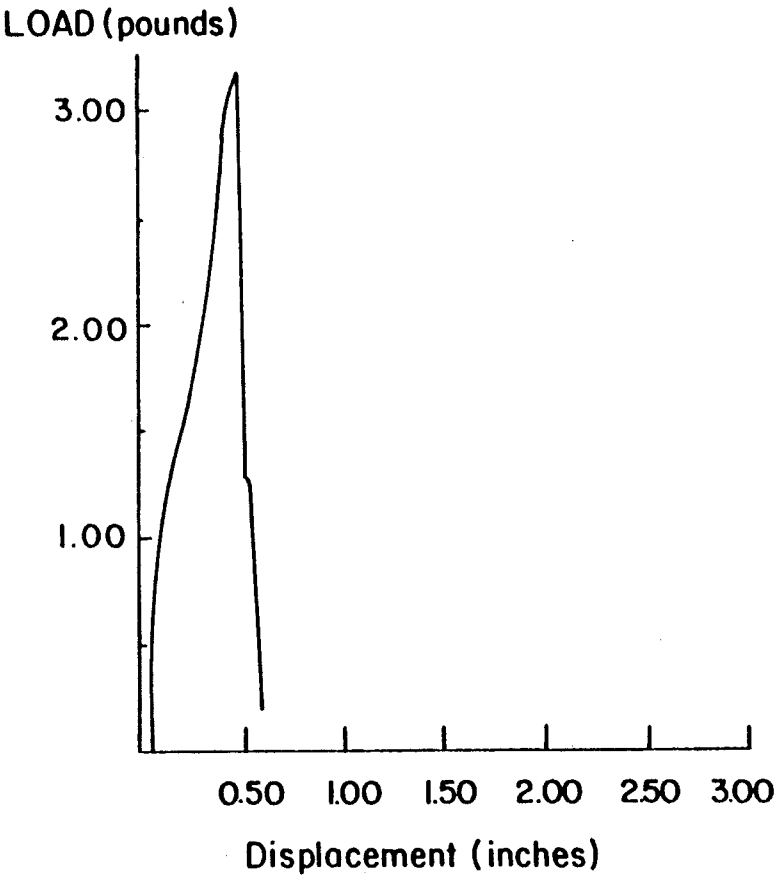
Figure 5C:
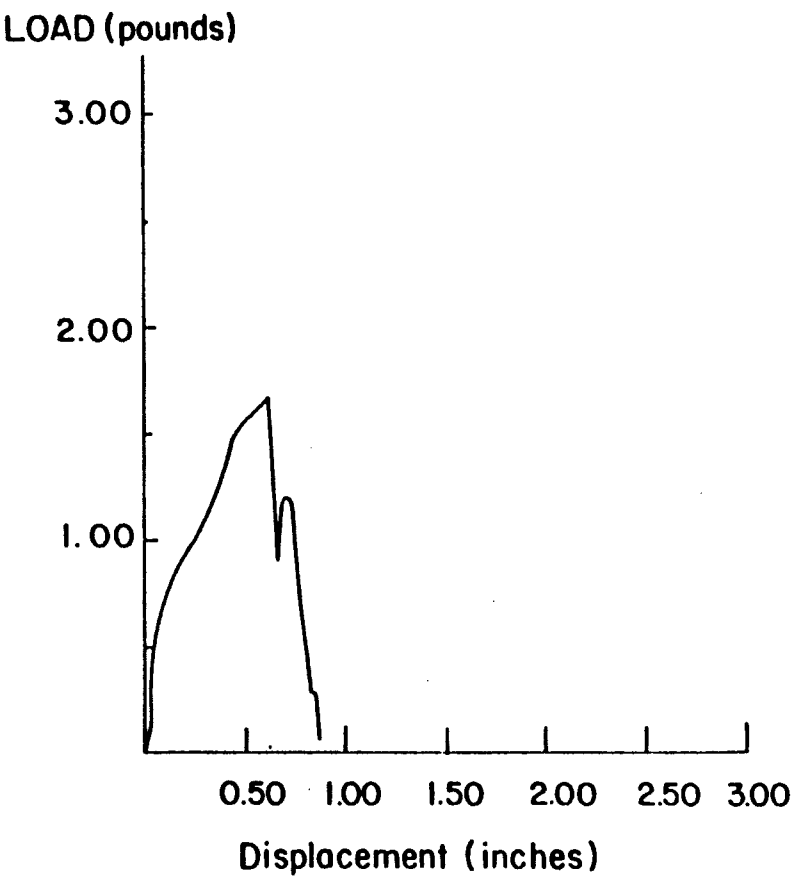

An SEM of this material is shown in FIG. 4. Notice the fiber bulking in the CD.

Figure 3:
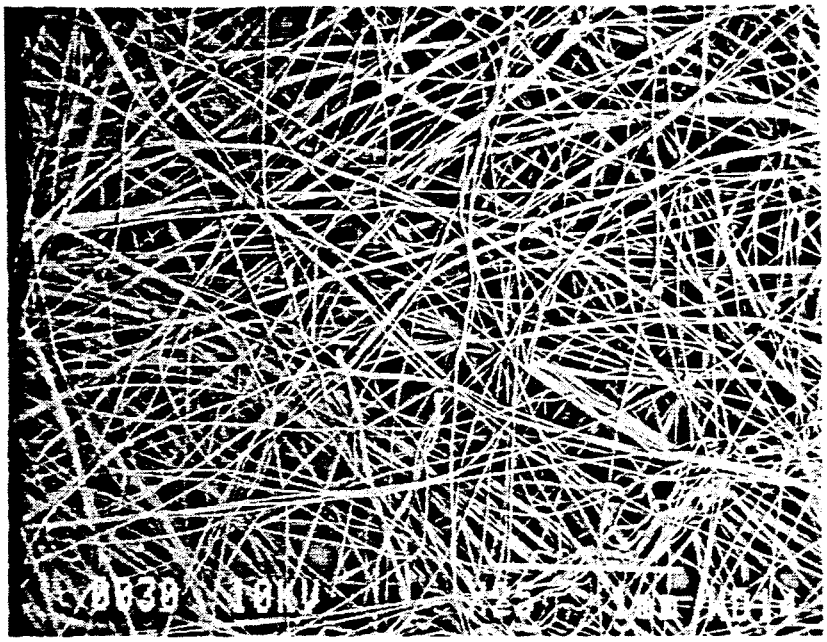
FIG. 3 is a SEM (scanning electron micrograph) (25 X magnification) of a straight fiber stabilized fabric of 100% sheath/core bicomponent fiber.

For comparison purposes, the physical properties of a non-creped, non-elastic fiber web made from the same 100% bicomponent fiber furnish are also listed in Table 1 under Sample No. 3302-1. This sheet was made in essentially the same way as sample 2639-6 except that (1) more fibers were pumped to the headbox giving a higher basis weight for 3302-1, (2) the sheet was pulled from the Yankee dryer without creping, and (3) the take off reel was moving at the same speed as the Yankee dryer, i.e., the sheet was not drawn. An SEM of this material is shown in FIG. 3. Notice how all the fibers are nearly straight.

EXAMPLE 2

Nonwoven Sample 2639-6 is the same as described in Example 1. This material was characterized and compared to conventionally produced nonwoven Sample 3437-6. This sample was made in essentially the same way as Sample 3302-1 except that the stock flow to the headbox was kept the same, i.e., the web on the forming wire and the Yankee had the same basis weight. Analysis included thickness and basis weight measurements, tensile testing up to sample fracture, and cyclic testing.

As a result of the necking in process, Sample 2639-6 had a thickness approximately three times that of Sample 3437-6 at the same time sample increased in basis weight by 40%. Results are presented in Table 2.

The results presented in Table 2 are averages of fiber test determinations; error indicators are two times standard deviation. It is clear that the process used to generate Sample 2639-6 results in a thicker material with an increase in basis weight.

TABLE 2

| | Thickness, Basis Weight and Bulk | | |
|---|---|---|---|
| Sample | Thickness 8 sheets (0.001 in.) | Basis Weight ($g/m^2$) | Bulk $cm^3/g$ |
| 2639-6 | 59.6 ± 2.2 | 12.1 ± .4 | 15.6 |

TABLE 2-continued

| | Thickness, Basis Weight and Bulk | | |
|---|---|---|---|
| Sample | Thickness 8 sheets (0.001 in.) | Basis Weight ($g/m^2$) | Bulk $cm^3/g$ |
| 3437-6 | 19.0 ± 0 | 8.7 ± .2 | 6.9 |

Tensile Tests

Peak load, percent elongation, and tensile energy absorption (TEA) were obtained and are presented in Table 3. Peak load and TEA were normalized by dividing by basis weight. As with the thickness and basis weight data, each value is the average of five determinations, and error indicators are two times standard deviation.

TABLE 3

| | Tensile Test Results | | |
|---|---|---|---|
| Sample | Peak Load ($lb/g/m^2$) | Elongation (%) | TEA × 1000 ($in\text{-}lb/in^2/g/m^2$) |
| 2639-6CD | .04 ± .01 | 60 ± 15 | 11 ± 5 |
| 2639-6MD | .10 ± .02 | 16 ± 3 | 15 ± 5 |
| 3437-6CD | .20 ± .04 | 16 ± 3 | 23 ± 7 |
| 3437-6MD | .34 ± .06 | 11.2 ± .4 | 24 ± 7 |

A large increase in stretch of Sample 2639-6 in the CD is very apparent. MD stretch is also increased (by around 40%) compared to Sample 3437-6. Both peak load and TEA of 2639-6, however are lower relative to the control. Differences in the two samples are readily apparent in graphs of load vs elongation. In FIG. 5, CD and MD graphs of the two samples are made using the same scale to facilitate comparison.

The substantial stretch of 2639-6 (FIG. 5A) in the CD is very obvious. It is also worth noting that the shape of the load-elongation curve of this sample is clearly different from the others. The slope of the curve slowly decreases before increasing again after a substantial amount of stretch, giving the curve a definite "S" shape. Unlike the other samples, where stretching the sample results in almost immediate stress on individual fibers, stretching Samples 2639-6 likely pulls out kinks and curves in the fibers before stretching the fibers themselves.

Cyclic testing was also carried out on 1-inch by 5-inch samples using a gauge length of 4 inches and a crosshead speed of 10 inches/minute. In the first part of the testing, five complete load-unload cycles were performed. Cycle displacement magnitudes were based on maximum elongations observed in corresponding tensile tests. For Sample 2639-6 in the MD and both CD and MD 3437-6 samples, displacement was set at 0.25 inches. Three different displacement magnitudes were used when Sample 2639-6 was tested in the CD: 0.5, 1.0 and 1.5 inches. These represent elongations which are approximately 20, 40 and 60% of the maximum elongation found in the tensile test.

Peak load for each cycle was measured. Also measured was energy loss during each cycle; this is the difference between the energy absorbed by the sample during loading and that released during unloading. Percentage length recovery (difference between stretched length and final sample length divided by the stretch magnitude) was also determined. Data obtained is presented in Table 4; load and energy values are again normalized by dividing by basis weight. Load and recovery values are averages of three determinations; energy values are averages of at least six determinations.

TABLE 4

| | Cycle 1 | 2 | 3 | 4 | 5 |
|---|---|---|---|---|---|
| | Peak Load during Cycling (lb/g/m$^2$ × 1000) | | | | |
| 2639-6CD, 0.5 in. | 6.2 ± .6 | 6.0 ± .4 | 6.0 ± .3 | 6.0 ± .2 | 5.9 ± .4 |
| 2639-6CD. 1.0 in. | 10 ± 3 | 10 ± 3 | 9 ± 3 | 9 ± 3 | 9 ± 3 |
| 2639-6CD, 1.5 in. | 19 ± 2 | 19 ± 2 | 18 ± 2 | 18 ± 2 | 18 ± 2 |
| 2639-6MD, .25 in. | 65 ± 14 | 63 ± 14 | 62 ± 14 | 62 ± 14 | 61 ± 14 |
| 3437-6CD, .25 in. | 116 ± 19 | 114 ± 19 | 112 ± 19 | 111 ± 19 | 110 ± 18 |
| 3437-6MD, .25 in. | 218 ± 11 | 214 ± 12 | 211 ± 11 | 209 ± 11 | 207 ± 11 |
| | Energy Loss during Cycling (in-lb/g/m$^2$ × 1000) | | | | |
| 2639-6CD, 0.5 in. | .42 ± .20 | .23 ± 0.7 | .20 ± .06 | .20 ± .04 | .17 ± .04 |
| 2639-6CD, 1.0 in. | 2.4 ± 1.1 | 1.1 ± .4 | .9 ± .4 | .8 ± .3 | .7 ± .3 |
| 2639-6CD, 1.5 in. | 6.4 ± 2.5 | 2.4 ± 1.1 | 1.9 ± .8 | 1.7 ± .7 | 1.6 ± .5 |
| 2639-6MD, .25 in. | 4.7 ± 1.6 | 1.6 ± .5 | 1.3 ± .4 | 1.1 ± .3 | 1.1 ± .3 |
| 3437-6CD, .25 in. | 9.4 ± 1.7 | 4.5 ± .5 | 3.6 ± .4 | 3.2 ± .4 | 3.0 ± .5 |
| 3437-6MD, .25 in. | 18.4 ± 3.6 | 8.5 ± 1.6 | 6.7 ± 1.3 | 6.0 ± 1.1 | 5.6 ± .9 |
| | Length Recovery during Cycling (%) | | | | |
| 2639-6CD, 1.0 in. | 72 ± 3 | 67 ± 6 | 67 ± 8 | 67 ± 2 | 64 ± 7 |
| 2639-6CD, 1.5 in. | 60 ± 3 | 56 ± 1 | 54 ± 2 | 53 ± 3 | 52 ± 3 |
| 2639-6MD, .25 in. | 57 ± 1 | 53 ± 2 | 52 ± 2 | 50 ± 1 | 49 ± 2 |
| 3437-6CD, .25 in. | 72 ± 0 | 68 ± 2 | 65 ± 2 | 63 ± 1 | 62 ± 2 |
| 3437-6MD, .25 in. | 66 ± 0 | 62 ± 0 | 59 ± 2 | 57 ± 1 | 56 ± 2 |

Table 4 again shows that Sample 2639-6 exhibits a large amount of stretch even at relatively low loads. Permanent percentage increase in length (for the cycling speed employed) of Sample 2639-6CD when stretched to 1 inch is approximately the same as that exhibited by Sample 3437-6CD when stretched to only 0.25 inch. It may be noted that length recovery data for Sample 2639-6CD when elongated in 0.5 inch cycles is not reported. Load-elongation data was somewhat erratic during the unload portion of the cycle in this test. It appeared, however, that there was very little permanent set at 0.5 inch; length recovery was near 100%.

In the second part of the cyclic testing, four complete load-unload cycles were run using the same displacements indicated above. After loading on the fifth cycle, the displacement was held for 30 seconds. Holding power, defined to be the load maintained after 30 seconds, was recorded. Stress decay and percentage loss in load during the 30 seconds during the fifth cycle were also determined. Table 5 presents averages obtained from three determinations for each of the samples; load has again been normalized for basis weight differences.

TABLE 5

| Sample | Holding Power (lb/g/m$^2$ × 1000) | Stress Decay (%) |
|---|---|---|
| | Stress Decay, and Holding Power (30 Seconds at Maximum Displacement in Fifth Cycle) | |
| 2639-6CD, 0.5 in. | 5.7 ± .04 | 4 ± 4 |
| 2639-6CD, 1.0 in. | 6.0 ± 3.0 | 25 ± 7 |
| 2639-6CD, 1.5 in. | 12.5 ± 1.6 | 27 ± 1 |
| 2639-6MD, .25 in. | 43.4 ± 0.6 | 29 ± 1 |
| 3437-6CD, .25 in. | 78 ± 15 | 24 ± 1 |
| 3437-6MD, .25 in. | 140 ± 28 | 24 ± 2 |

Perhaps most notable is the small degree of change in load with time when Sample 2639-6CD was stretched 0.5 inch. Stress decay was only 4%.

We claim:

1. A thermally bonded non-woven fabric having a degree of elasticity in a first direction which is substantially greater than the degree of elasticity in a second direction which is perpendicular to said first direction, comprising:

a network of thermally bondable bicomponent fibers which comprise a core having a first melting point and a sheath arranged concentrically around said core and having a second melting point which is lower than said first melting point, portions of which extending generally in said first direction are crimped to a degree which is substantially greater than the degree of crimp or portions extending generally in said second direction.

2. The fabric of claim 1, wherein said fabric has a degree of elasticity of at least 5% and a bulk of 7 to 20 cm$^3$/g.

3. The fabric of claim 1, which further comprises additional fibers which are not thermally bondable bicomponent fibers.

4. The fabric of claim 1, which is prepared by crimping a fabric comprising said thermally bondable bicomponent fibers while restraining said fibers in a first direction to an extent less than the degree of restrain in a second direction which is perpendicular to said first direction at a temperature and other conditions which cause said fibers to bend in said second direction to en extent which is higher than the extent said fibers bend in said first direction.

5. The fabric of claim 4, wherein said strain in said second direction is caused by pulling said fabric from a dryer drum while the surfaces of said thermally bondable bicomponent fibers are at a temperature which is higher than the melting point of said surfaces of said fibers.

6. The fabric of claim 5, wherein said fabric is formed by a wet laid process and is then presented to said dryer drum.

7. The fabric of claim 5, wherein said thermally bondable bicomponent fibers are isotropically oriented prior to crimping.

8. The fabric of claim 4, wherein crimping is conducted at a temperature which is higher than the melting point of said sheath and between the melting point and glass transition temperature of said core.

9. The fabric of claim 1, wherein said core of said fibers is formed from a polyolefin, polyamide, polyester or an acrylic based polymer.

10. The fabric of claim 1, wherein said core of said fibers is formed from a polyester.

11. The fabric of claim 10, wherein said polyester is polyethylene terephthalate.

12. The fabric of claim 1, wherein said sheath of said thermally bondable bicomponent fiber is formed from a polymer selected from the group consisting of a polyolefin, a polyamide, a copolyamide, a copolyester, a polyester and an acrylic based polymer.

13. The fabric of claim 1, wherein the melting point of said sheath is 110° to 200° C.

14. The fabric of claim 1, wherein the melting point of said sheath is 115° to 130° C.

15. The fabric of claim 1, wherein the melting point of said sheath is at least 30° C. lower than the melting point of said core.

16. The fabric of claim 1, wherein the melting point of said sheath is at least 40° C. lower than the melting point of said core.

17. The fabric of claim 1, wherein said fibers have an average denier of 1 to 4 and an average length of 8 to 20 mm.

18. The fabric of claim 1, which has a thickness of 0.005 to 0.2 mm.

19. The fabric of claim 1, which has a thickness of 0.01 to 0.1 mm.

20. The fabric of claim 1, which has a bulk of 7 to 20 $cm^3/g$.

21. The fabric of claim 1, which has a bulk of 9 to 18 $cm^3/g$.

22. The fabric of claim 1, which has a bulk of 10 to 16 $cm^3/g$.

23. A wet-laid fabric, comprising:

wet laid thermally bonded, bicomponent fibers which comprise a core having a first melting point and a sheath arranged concentrically around said core and having a second melting point which is lower than said first melting point, wherein said fabric has a bulk of at least 7 $cm^3/g$ and has a degree of elasticity in one direction of at least 5% and wherein portions of said thermally bondable bicomponent fibers extending generally in a direction parallel to the direction in which said fabric exhibits a degree of elasticity exceeding 5% are crimped to a degree which is substantially greater than the degree of crimp of portions extending generally perpendicular thereto.

24. The fabric of claim 23, which has a bulk of 9 to 18 $cm^3/g$.

25. The fabric of claim 23, which has a degree of elasticity of 10 to 75%.

26. The fabric of claim 23, which has a degree of elasticity of 50 to 70%.

* * * * *